United States Patent [19]

Momose et al.

[11] 4,131,494

[45] Dec. 26, 1978

[54] CORROSION RESISTANT MAGNETIC ALLOY

[75] Inventors: Kenichiro Momose, Ebina; Kiyoshi Kumagai, Yokohama, both of Japan

[73] Assignee: Tokyo Shibaura Electric Co., Ltd., Kawasaki, Japan

[21] Appl. No.: 774,500

[22] Filed: Mar. 4, 1977

[30] Foreign Application Priority Data

Mar. 8, 1976 [JP] Japan ..... 51/24234
Jul. 28, 1976 [JP] Japan ..... 51/89042

[51] Int. Cl.[2] ..... H01F 1/14; C22C 38/42; C22C 38/52

[52] U.S. Cl. ..... 148/31.57; 75/122; 75/125; 75/128 B; 148/101

[58] Field of Search ..... 75/125, 134 F, 123 K, 75/122, 128 B; 148/100, 101, 31.57, 127

[56] References Cited

U.S. PATENT DOCUMENTS

| | | | |
|---|---|---|---|
| 2,002,689 | 5/1935 | Bozorth et al. | 75/123 K |
| 3,892,604 | 7/1975 | Thornberg et al. | 75/123 K |
| 4,028,144 | 6/1977 | Tomishima et al. | 148/31.55 |

*Primary Examiner*—Arthur J. Steiner
*Attorney, Agent, or Firm*—Cushman, Darby & Cushman

[57] ABSTRACT

Corrosion resistant magnetic alloy consisting essentially of Ni (20 to less than 35% by weight), Cr (3 to 15% by weight), at least one of Co (0.1 to 10% by weight) and Cu (0.1 to 15% by weight), and the balance of essentially Fe. The alloy is excellent in magnetic property, high in corrosion resistance and, thus, suitable for use as a magnetic shielding material.

3 Claims, No Drawings

CORROSION RESISTANT MAGNETIC ALLOY

BACKGROUND OF THE INVENTION

This invention relates to a magnetic alloy, particularly, to a corrosion resistant magnetic alloy very suitable for use as a magnetic shielding material.

Permalloy, which is a Ni-Fe type alloy, is well known as a magnetic alloy. In particular, "45 permalloy" containing 45% by weight of Ni is widely used as a magnetic shielding material. This alloy is relatively small in Ni content among various kinds of Permalloy.

This alloy (45 Permalloy), however, tends to rust if exposed to humid circumstances. The rusting is caused even under the ordinary atmosphere in the course of its long period of use. Accordingly, anti-corrosion treatment is required if 45 Permalloy is used as a magnetic shielding material.

Chromium is considered effective for improving the corrosion resistance of Ni-Fe type alloy. However, the Cr addition was considered unfavorable in terms of the magnetic property, of the resultant alloy. Under the circumstances, it is attempted recently to add Si or the like to Ni-Fe-Cr type alloy in order to produce an alloy satisfactory in both corrosion resistance and magnetic property. Alloys of this type are reported in Japanese Patent Application Publication No. 2491/76 and Japanese Patent Application Disclosure No. 114,517/74.

However, the Ni-Fe-Cr alloy of these types is said to necessitate at least 35% by weight of Ni. If the Ni content is less than 35%, the alloy is said to be quite unsatisfactory in magnetic property, rendering the alloy unsuitable for actual uses. The alloy containing such a large amount of expensive Ni is uneconomical. Naturally, it is of high concern in the field to produce an alloy having a smaller Ni content.

SUMMARY OF THE INVENTION

An object of this invention is to provide an alloy high in corrosion resistance, magnetic permeability and magnetic flux density and, thus, suitable for use as a magnetic shielding material.

The corrosion resistant magnetic alloy according to this invention consists essentially of Ni (20 to less than 35 wt %), Cr (3 to 15 wt %), at least one of Co (0.1 to 10 wt %), and Cu (0.1 to 15 wt %), and the balance of essentially Fe.

DETAILED DESCRIPTION OF THE INVENTION

Through extensive researches, the inventor of this invention has found that the addition of Co and/or Cu to the Ni-Fe-Cr alloy is effective for enabling the resultant alloy to exhibit a high magnetic property and a high corrosion resistance even if the Ni content thereof is lower than 35% by weight. A suitable amount of Co which is added to the Ni-Fe-Cr alloy ranges from 0.1 to 10 wt %. On the other hand, a suitable amount of Cu ranges from 0.1 to 15 wt %. The Ni-Fe-Cr alloy having Co and/or Cu as additional component is substantially equal to 45 Permalloy in an initial magnetic permeability and exhibits a magnetic flux density high enough to provide a practical magnetic alloy, even if the Ni content of the alloy is less than 35 wt %. In addition, the alloy of this type is highly resistant against corrosion.

The corrosion resistant magnetic alloy according to this invention consists essentially of Ni (20 to less than 35 wt %), Cr (3 to 15 wt %), at least one of Co (0.1 to 10 wt %) and Cu (0.1 to 15 wt %), and the balance of essentially Fe. Preferably, the alloy consists essentially of Ni (30 to less than 35 wt %), Cr (8 to 12 wt %), at least one of Co (2 to 5 wt %) and Cu (1 to 5 wt %), and the balance of essentially Fe.

The Ni content lower than 20 wt % renders the alloy unsatisfactory in magnetic permeability, but the value exceeding 35 wt % makes the alloy expensive and, thus, is not preferred in terms of actual uses. The Cr content falling outside the range of from 3 to 15 wt % is not effective for enabling the alloy to exhibit a satisfactory corrosion resistance. Further, each of Co and Cu fails to improve the magnetic flux density of the alloy if the content thereof is less than 0.1 wt %. On the other hand, the workability of the alloy is impaired if the Co content exceeds 10 wt % or the Cu content exceeds 15 wt %.

In the present invention, additional elements each as Mo, W, V, Nb, Ta, Mn, Ge, Ti, Al and Si may be added to the magnetic alloy of the above-specified composition. A suitable amount of these additional elements is less than 10 wt %. These elements serve to improve the magnetic permeability of the magnetic alloy.

Described in the following are examples of this invention.

EXAMPLES

Various types of ingot were prepared by melting various masses of metals prepared by adding various amounts of Co and/or Cu to the various kinds of Fe-Ni-Cr type alloy. The melting was carried out by a high frequency melting method under vacuum or atmospheric pressure.

The resultant ingot was subjected to hot processing and cold processing so as to obtain a plate 0.5 mm thick, followed by shaping the plate to provide a ring for the measurement of magnetic property and a test piece for the subsequent corrosion resistance test. The samples thus prepared were heat-treated prior to the tests for the measurements of the magnetic property and the corrosion resistance.

Table 1 below shows the results of the tests. In the table, $\mu i$, $\mu e$ and $B_{10}$ (G) denote respectively, the initial magnetic permeability, the effective magnetic permeability, and the magnetic flux density (G) under a magnetic intensity of 10 oersteds.

Table 1

| | | Composition (weight %) | | | | | | Magnetic Properties | | | Corrosion Resistance (24 hours after brine spray) |
|---|---|---|---|---|---|---|---|---|---|---|---|
| | | Ni | Cr | Co | Cu | Si | Fe | $\mu i$ | $\mu e$ | $B_{10}$(G) | |
| Control | 1 | 45.0 | — | — | — | — | balance | 5000 | 1800 | 15000 | Rusted |
| " | 2 | 31.0 | 9.5 | — | — | 0.5 | " | ≈0 | ≈0 | 500 | Not rusted |
| " | 3 | 18.0 | 9.0 | 3.0 | — | 0.5 | " | 500 | 200 | 1000 | " |
| " | 4 | 18.0 | 9.0 | — | 3.0 | 0.5 | " | 500 | 200 | 1000 | " |
| " | 5 | 30.0 | 10.0 | 0.05 | — | 0.5 | " | ≈0 | ≈0 | 500 | " |
| " | 6 | 30.0 | 10.0 | — | 0.05 | 0.5 | " | ≈0 | ≈0 | 500 | " |
| Example | 1 | 20.0 | 3.0 | 0.1 | — | 0.5 | " | 1000 | 700 | 2000 | " |
| " | 2 | 20.0 | 3.0 | — | 0.1 | 0.5 | " | 1000 | 700 | 2000 | " |
| " | 3 | 25.0 | 5.0 | 3.0 | — | 0.3 | " | 1500 | 900 | 2500 | " |
| " | 4 | 28.0 | 8.0 | 7.0 | — | 0.3 | " | 6000 | 1900 | 2800 | " |

Table 1-continued

| | | Composition (weight %) | | | | | | Magnetic Properties | | | Corrosion Resistance (24 hours after brine spray) |
|---|---|---|---|---|---|---|---|---|---|---|---|
| | | Ni | Cr | Co | Cu | Si | Fe | $\mu i$ | $\mu e$ | $B_{10}$(G) | |
| " | 5 | 30.0 | 8.0 | 2.0 | — | 0.3 | " | 5000 | 1800 | 2200 | " |
| " | 6 | 30.0 | 8.0 | — | 1.0 | 0.3 | " | 4000 | 1700 | 2000 | " |
| " | 7 | 30.0 | 9.0 | — | 4.0 | 0.5 | " | 7000 | 2500 | 3800 | " |
| " | 8 | 30.0 | 9.0 | 6.0 | 3.0 | 0.4 | " | 5500 | 2000 | 6300 | " |
| " | 9 | 31.0 | 9.5 | 6.0 | — | 0.5 | " | 9000 | 2500 | 4500 | " |
| " | 10 | 32.0 | 10.0 | 4.0 | 2.0 | 0.5 | " | 15000 | 5000 | 5500 | " |
| " | 11 | 34.0 | 9.5 | — | 3.0 | 0.9 | " | 9000 | 2700 | 4200 | " |
| " | 12 | 34.2 | 9.5 | — | 3.0 | 0.9 | " | 9000 | 2700 | 4300 | " |
| " | 13 | 34.5 | 10.0 | 3.0 | — | 0.5 | " | 7000 | 2400 | 5300 | " |
| " | 14 | 34.5 | 12.0 | 5.0 | — | 0.5 | " | 7000 | 2400 | 5000 | " |
| " | 15 | 34.5 | 12.0 | — | 5.0 | 0.5 | " | 6500 | 2300 | 4500 | " |
| " | 16 | 34.5 | 15.0 | 10.0 | — | 0.5 | " | 3000 | 1100 | 2500 | " |
| " | 17 | 34.5 | 15.0 | — | 15.0 | 0.5 | " | 1000 | 700 | 2000 | " |

Table 1 clearly shows that the alloy according to this invention, which consists essentially of Ni (20 to less than 35 wt %), Cr (3 to 15 wt %), at least one of Co (0.1 to 10 wt %) and Cu (0.1 to 15 wt %) and the balance of essentially Fe, exhibits excellent magnetic property. It is seen that the values of $\mu i$ and $B_{10}$ (G) of the invented alloy are as high as at least 1000 and 2000, respectively. Table 1 also shows that the magnetic property is particularly excellent where the alloy consists essentially of Ni (30 to less than 35 wt %), Cr (8 to 12 wt %), at least one of Co (2 to 5 wt %) and Cu (1 to 5 wt %), and the balance of essentially Fe.

A known alloy of Permalloy is featured in, particularly, its high initial magnetic permeability. However, the magnetic alloy of this invention exhibits an initial magnetic permeability equal to or higher than that of 45 Permalloy containing 45% by weight of Ni, in spite of the fact that the alloy of this invention contains as small as 20 to 35% by weight of Ni. In addition, the alloy of this invention is highly resistant against corrosion.

As described in detail, the corrosion resistant magnetic alloy according to this invention compares favorably with 45 Permalloy in magnetic property. In addition, the invented alloy is high in corrosion resistance and very economical because the content of expensive Ni is low. It follows that the alloy of this invention is very much useful as a magnetic shielding material and produces a high industrial merit.

What we claim is:

1. A corrosion resistant magnetic alloy with high magnetic permeability, said alloy consisting essentially of Ni in an amount ranging from 30% to less than 35% by weight, Cr in an amount ranging between 8% and 12% by weight, a metal selected from the group consisting of Co, Cu and mixtures thereof, and the balance of essentially Fe, the Co content when present ranging between 2% and 5% by weight and the Cu content when present between 1% and 5% by weight, the initial magnetic permeability of said alloy being at least 1000 and the flux density under a magnetic intensity of 10 oersteds.

2. A corrosion resistant magnetic alloy with high magnetic permeability, said alloy consisting essentially of Ni in an amount ranging from 30% to less than 35% by weight, Cr in an amount ranging between 8% and 12% by weight, Cu in an amount between 1% and 5% by weight and the balance of essentially Fe, the initial magnetic permeability of said alloy being at least 1000 and the flux density under a magnetic intensity of 10 oersteds.

3. A corrosion resistant magnetic alloy with high magnetic permeability, said alloy consisting essentially of Ni in an amount ranging from 30% to less than 35% by weight, Cr in an amount ranging between 8% and 12% by weight, Co in an amount ranging between 2% and 5% by weight, and the balance of essentially Fe, the initial magnetic permeability of said alloy being at least 1000 and the flux density under a magnetic intensity of 10 oersteds.

* * * * *